United States Patent [19]

Wahl et al.

[11] 4,125,741

[45] Nov. 14, 1978

[54] DIFFERENTIALLY COMPRESSED, MULTI-LAYERED, CONCENTRIC CROSS LAY STRANDED CABLE ELECTRICAL CONDUCTOR, AND METHOD OF FORMING SAME

[75] Inventors: Ralph E. Wahl, Trumbull; Alfred C. Bruhin, Huntington, both of Conn.

[73] Assignee: General Electric Company, New York, N.Y.

[21] Appl. No.: 838,202

[22] Filed: Sep. 30, 1977

[51] Int. Cl.[2] ..... H01B 7/00

[52] U.S. Cl. ..... 174/120 SC; 174/113 A; 174/130; 57/213; 57/217; 57/7; 57/15

[58] Field of Search ..... 57/145, 148, 149, 156, 57/160, 161, 166, 138; 174/128 R, 130, 107, 113 A, 120 SC

[56] References Cited

U.S. PATENT DOCUMENTS

| | | | |
|---|---|---|---|
| 3,234,722 | 2/1966 | Gilmore | 57/145 |
| 3,339,012 | 8/1967 | Hutchins | 174/130 |
| 3,444,684 | 5/1969 | Schoerner | 57/161 |
| 3,885,085 | 5/1975 | Bahder | 174/120 SC |

*Primary Examiner*—J. V. Truhe
*Assistant Examiner*—John H. Bouchard
*Attorney, Agent, or Firm*—R. G. Simkins; P. L. Schlamp

[57] ABSTRACT

A compressed, multi-layered, concentric layer stranded cable electrical conductor with each succeeding overlying layer of strands helically wound in an alternately opposite direction, comprising the product of sequentially circumferentially compressing each succeeding overlying layer of cross lay strands to a regressively reduced state of consolidation.

24 Claims, 6 Drawing Figures

DIFFERENTIALLY COMPRESSED, MULTI-LAYERED, CONCENTRIC CROSS LAY STRANDED CABLE ELECTRICAL CONDUCTOR, AND METHOD OF FORMING SAME

BACKGROUND OF THE INVENTION

In addition to the common solid type of electrical conductor consisting simply of a continuous rod-like body of solid metal in an apt diameter, electrical conductors typically are composed of groupings of a plurality of individual metal strands arranged or laid down in any one of a number of different cable patterns or schemes common to the art, for example, concentric lay, concentric parallel lay, concentric cross lay, annular, segmental, rope stranded, bunched, and the like.

Concentric lay stranded conductors are typically constructed with a single central or core strand having one layer of six strands, or a multiplicity of layers of strands with the number of strands in each succeeding overlying layer increasing in every layer in multiples of six strands, for example, six, twelve, eighteen, twenty-four, et seq., concentrically arranged about the axis of the conductor such as each of said layers of strands being sequentially helically wound concentrically around the single central or core strand. A concentric parallel lay strand pattern comprises an arrangement wherein the strands or layers of strands are helically wound in the same direction concentrically around the central or core strand, whereas a concentric cross lay strand pattern comprises an arrangement wherein each succeeding overlying layer of strands is helically wound in an alternatingly opposite direction to any adjoining layer of strands, either below or above.

Moreover, certain of these types of stranded cable electrical conductors can be consolidated to various degrees, such as the compressed or compacted conductors of various strand pattern shown in U.S. Pat. Nos. 1,943,087; 3,164,670; 3,234,722; 3,352,098; 3,383,704; 3,444,684; 3,760,093; and 3,823,542. Compressed stranded conductors are generally defined as "one or more layers of any stranded conductor consisting of seven wires or more" which have been compressed to reduce the outside diameter of the conductor by not more than three percent. Note, for instance ASTM-B8-72. Compacted stranded conductors generally comprise those stranded conductors which have been compacted to an outside diameter of more than 3 percent, such as, for example, compacted up to about eight to ten percent. The application of pressure for the consolidation of stranded cable conductors in forming either compressed or compacted types of products can be applied either in a single pressing to the exterior of the completed composite assembly of strands making up the conductor, or in a series of pressings in sequence to several or all layers of strands individually following their winding about the underlying unit, such as in U.S. Pat. Nos. 1,943,087; 3,383,704; and 3,760,093.

Although each of the prior types of stranded cable designs, such as referred to above, may be outstanding or superior in one or more particular properties or attributes, such as degree of flexibility, or on the other hand provide a saving in insulating covering material due to a compaction reduced diameter, each of said designs entails some offsetting shortcomings and thus none provides an overall improved and outstanding electrical cable of all-around enhanced properties or attributes.

For instance, the compressing of multi-layered, concentric lay cables having succeeding overlying layers of strands helically wound in opposite directions, to reduce their diameter, either by means of a single compressing force applied only to the exterior of the assembled composite of overlying layers of strands or in a series of substantially equal compressing forces applied in sequence to each layer of strands as formed, results in indentations or notches being impressed into the individual strands of the layers at the location of their crossing contacts or intersections with strands of adjoining layers. The presence of any surface irregularities in the strands, such as indentations or notches, evidently constitutes a substantial detriment both in the manufacturing operation for producing insulated conductors with such a cable, and in the performance of the product thereof. For example, indentations or notches impressed in the strands at their intersections with crossing strands of an adjoining layer reduces flexability by providing mortice-like connections or grips between the strands which resist relative movement of the strands or their layers when subjected to bending or flexing.

However, when such a cable construction is to be enclosed within an extrusion molded plastic covering such as is common in insulated electrical conductors, the presence of indentations or notches in the strands causes a far greater detriment than detracting from flexibility. Namely, the forced bending or flexing of such a compressed, concentric cross lay stranded cable, such as is inherent in manufacturing operations, in moving around capstans or winding on reels, and thereafter in service, wrenches the mortice-like gripped or locked strands loose, prying them from their restraining intersecting indentations or notches and driving them from their initial relative positions and arrangement, thereby distorting and stretching or extending the shape and length of such strained strands. This distortion and stretching of the force displaced strands frequently causes a disarrangement or separation of the parallel contacting arrangement of the layers of strands, particularly in the outermost layer of strands, and the radial expansion or bulging of the strands which results in significant open spaces or gaps therebetween. The presence of any such openings or gaps in the outermost layer of distorted and stretched strands permits the adverse entry and internal dispersal of plastic materials, such as semiconducting or insulating compositions, during extrusion molding of coverings or coatings thereof over the stranded cable in the production of insulated electrical conductors. Heretofore, this shortcoming has necessitated the use of an intermediate barrier in the form of a film or tape applied over the assembled stranded cable and thus intermediate the stranded cable and the plastic covering or enclosure extruded thereover.

The effects of prior art compressing means upon such cross lay stranded cable with the impression of indentations or notches, and the resultant disarrangement or separation due to distortion and stretching, is diagrammatically illustrated in FIGS. 4, 5 and 6.

For example, as shown in FIG. 4, indentations, identified as I, are impressed in the underlying layer of strands, identified as U, caused by compressing the overlying layer of strands, identified as O. In FIG. 5 the indentations I are shown in a strand of an underlying layer U resulting from compressing the overlying layer of strands prior to an assembly of alternately helically wound strands for a cable being significantly flexed or bent, such as by coiled around a capstan or reel. The distance from the center of the assembly of alternately helically wound strands to the annular axis of a given overlying layer of strands O, or radius, is represented in FIG. 5 by the line R. In FIG. 6, the assembly of alternately helically wound strands for a cable of FIG. 5 is illustrated after significant flexing or bending such as by coiling around a capstan or reel, whereupon the strands of the overlying layer O are forced from their original position within the assembly and dislodged from within the adjoining indentation impressed in the underlying strand U, and the strands located in the outside of the bend become separated or spaced from each other with gaps therebetween. The dislodgement of the strands in an overlying layer O from within the compression formed indentations I of an underlying strand U, thus increases the radius R or distance from the center of the assembly of alternately helically wound strands to the annular axis of a given overlying layer of strands O, stretches the strands and separates the strands located in the outside of a bend.

SUMMARY OF THE INVENTION

This invention relates to novel and improved electrical conductor cables of a variety of advantageous properties and attributes, and a unique method of producing the same, comprising a compressed, multi-layered, concentric lay stranded cable with the strands of each succeeding overlying layer of strands helically wound in an alternatingly opposite direction to those of any adjoining layers of strands and circumferentially compressed to an overall outside diameter reduction of not more than about three percent of the uncompressed diameter of the cable. The method of this invention which produces the improved compressed, multilayered, concentric cross lay stranded cable, comprises circumferentially compressing each helically wound layer of strands individually in sequence to a substantially different degree of compression, proceeding from the relatively greatest degree of compression applied upon the innermost layer and in regressively reduced levels of compression applied to such succeeding overlying layer of strands.

OBJECTS OF THE INVENTION

It is a primary object of this invention to provide a novel and improved electrical conductor of many advantageous properties and attributes, and a unique method of producing same.

It is also an object of this invention to provide a new compressed, multi-layered, concentric cross lay stranded cable electrical conductor having improved properties and attributes.

It is a further object of this invention to provide a novel differentially compressed, multi-layered, concentric lay stranded cable electrical conductor with each succeeding overlying layer of strands helically wound in an alternatingly opposite direction, of improved flexibility and wherein the individual strands of the outermost overlaying layer of parallel aligned and helically wound strands are retained in tight abutting contact with each other sufficient to preclude entry or passage therebetween of plastic material molded thereover under high pressures such as by extrusion molding.

It is a still further object of this invention to provide a unique differentially compressed, multi-layered, concentric cross lay stranded cable electrical conductor which effectively precludes the occurrence of "strike-through" or internal penetration of plastic material extrusion molded thereover under high pressure without the need for commonly used barrier materials such as intermediately applied tapes or films, thereby saving the added time and costs of applying such a barrier; is of improved flexibility due in part to the effective avoidance of physically deforming the strands during compression; and also is of reduced overall or outside diameter whereby a substantial savings in the quantity of covering material, such as insulating, semiconductive, jacketing, etc., compositions, for a required or apt thickness thereof is realized.

It is additionally an object to this invention to provide a new and improved method of producing compressed, multi-layered, concentric lay stranded cable electrical conductor having each succeeding overlying layer of strands helically wound in an alternatingly opposite direction, comprising the application of a different level of compression to each individual layer of strands, in sequence, without discernibly deforming or damaging the individual strands at the locations of their intersections with crossing strands of adjoining layers.

DESCRIPTION OF A PREFERRED EMBODIMENT

This invention primarily deals with compressed, multi-layered, concentric lay stranded cable type of electrical conductors wherein each succeeding overlying layer of strands is helically wound in an alternatingly opposite direction to any adjoining layers of strands, and the stranded cable is reduced in diameter less than 3 percent by the compression.

Figure 1:
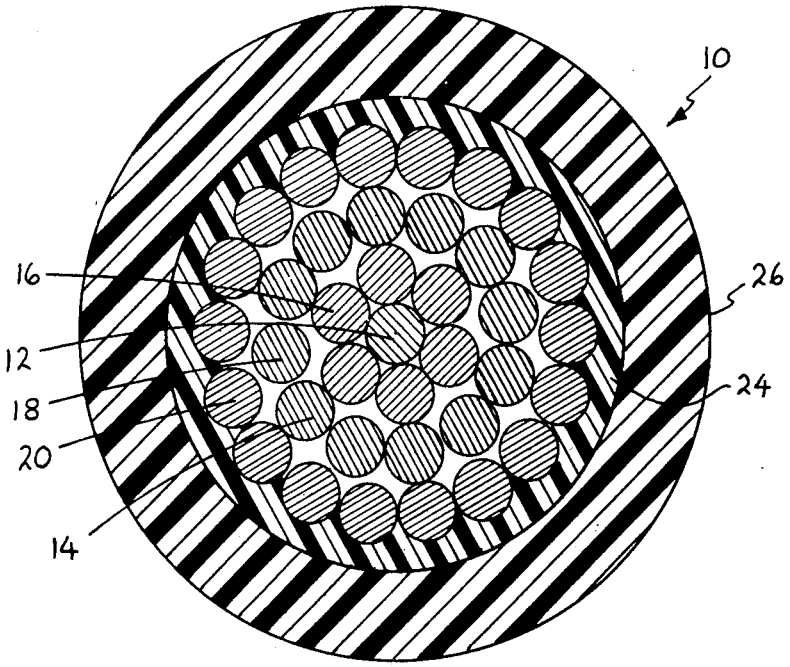
FIG. 1 comprises a cross-sectional view of a differentially compressed, multi-layered, concentric cross lay insulated electrical conductor constructed according to this invention.
Figure 2:
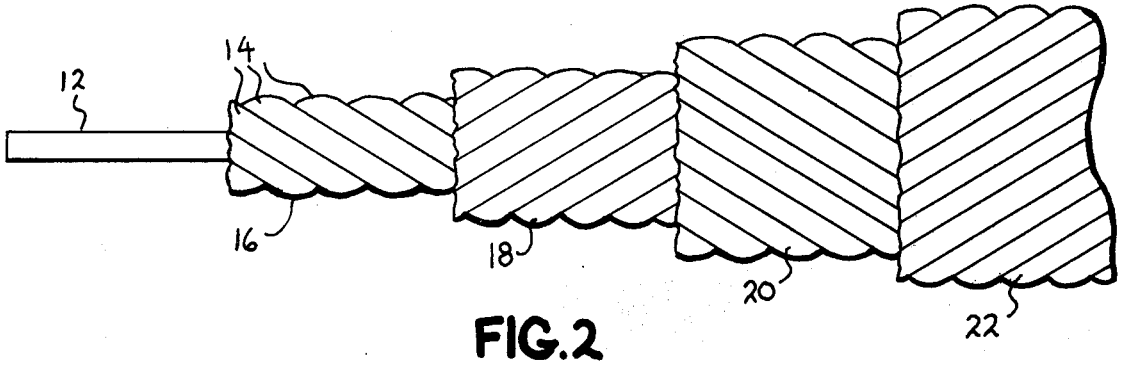
FIG. 2 comprises a fragmentary elevation view with portions of layers cut away of a differentially compressed, multi-layered, concentric cross lay cable electrical conductor of this invention.
Figure 3:
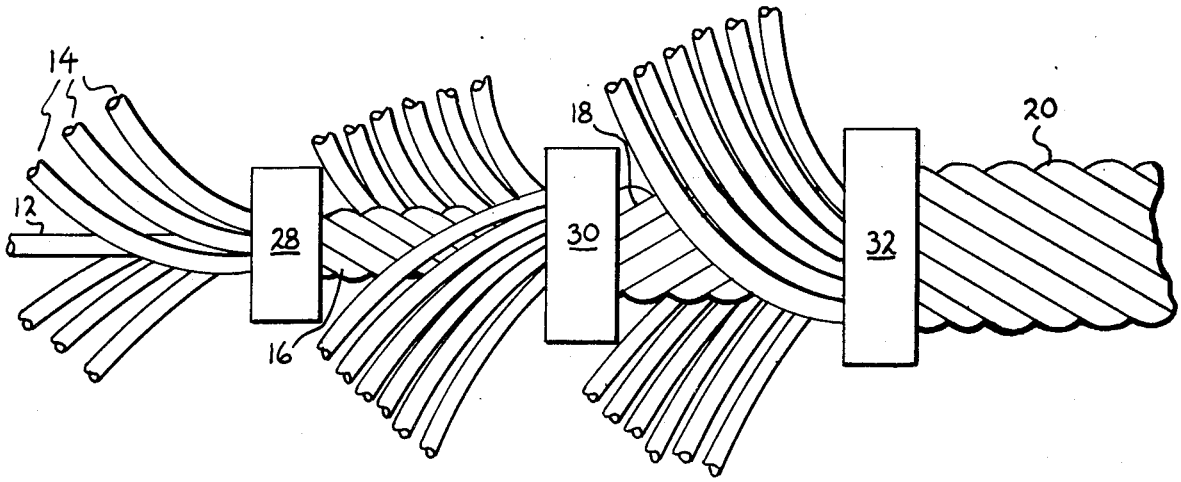
FIG. 3 comprises a schematic view illustrating the method of this invention for producing differentially compressed, multi-layered, concentric cross lay cable electric conductors, and the sequence of operations of the method; and, FIGS. 4, 5 and 6 of the drawing comprise diagrammatic illustrations of deleterious effects upon concentric cross lay stranded cable which has been compressed in the conventional manner according to the prior art practices.
Figure 4:
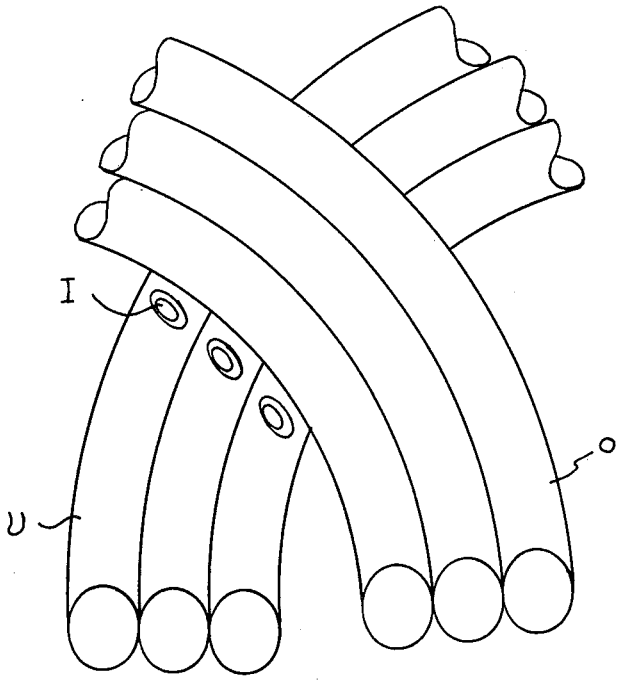
PRIOR ART FIG. 4
Figure 5:
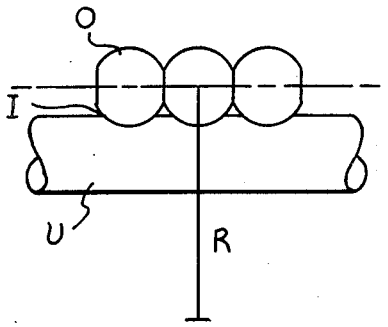
PRIOR ART FIG. 5
Figure 6:
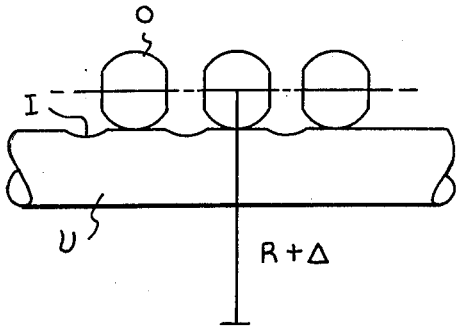
PRIOR ART FIG. 6

Referring to the drawing, as shown in FIGS. 1, 2 and 3, the construction of the differentially compressed, multi-layered, concentric cross lay strand cable 10 of this invention comprises a central or core strand 12 with a plurality of strands concentrically arranged thereabout. Six or other apt number of strands 14 are helically wound about the central or core strand 12 to form an innermost layer 16 of strands, and one or more additional layers of strands 14 such as layer 18 comprising twelve, or other apt number of individual strands 14, layer 20 comprising eighteen, or other apt number of individual strands 14, layer 22 comprising twenty-four, or other apt number of individual strands 14, are successively applied overlying the innermost layer 16, such as illustrated. Additional layers of strands, more than illustrated in the drawing, can be employed for larger capacity cables, such as a fifth layer comprising thirty or other apt number of strands, a sixth layer comprising thirty-six or other apt number, a seventh layer comprising forty-two or other apt numbers, et seq.

However, regardless of the number of layers 16, 18, 20, 22, et seq., of strands in the cable utilized to meet the performance requirements of the electrical conductor, each succeeding overlying layer of strands 14 is helically wound concentrically about the underlying components in an alternatingly opposite direction to any adjoining layers of strands such as illustrated in the drawing. Thus, the resultant cable construction comprises a multi-layered, concentric cross lay stranded cable arrangement.

As illustrated in FIG. 1 of the drawing, one or more bodies or layers of plastic material, such as a conventional polymeric semiconductive layer 24 and a dielectric insulating composition 26, can be extrusion molded under high pressures about and covering the stranded cables of this invention as is common in the manufacture of electrical conductors.

The above described multi-layered, concentric cross lay stranded cable conductors are compressed to reduce the overall outside diameter of the composite assembly to not more than up to about three percent, and preferably to reduce the stranded conductor's diameter approximately 2.5 percent, by means of a series of differential compressions applied according to this invention.

Referring to the schematic illustration of FIG. 3, the means of producing the improved differentially compressed, multi-layered, concentric cross lay stranded cable without discernibly deforming or damaging the individual strands, comprises circumferentially compressing each layer of helically wound strands individually in sequence with the innermost layer 16 of helically wound strands being compressed to the greatest degree of diameter reduction and each succeeding overlying layer of helically wound strands, such as layer 18, 20 etc., being compressed in sequence to a regressively reduced degree of diameter reduction. As shown in FIG. 3, the innermost helically wound layer 16 of strands 14 is circumferentially compressed to the greatest degree of diameter reduction following its winding thereabout, such as by passing the incomplete cable assembly of the central strand 12 and wound layer 16 through a first reducing die 28; next the succeeding overlying layer 18 of helically wound strands is circumferentially compressed to a significantly reduced degree of diameter reduction, compared to the degree of compression of the underlying layer of strands, following its winding over the innermost layer 16, such as by passing the incomplete cable assemblage thereof through a second reducing die 30; then the next succeeding overlying layer 20 of helically wound strands thereabout is circumferentially compressed to a further significantly reduced degree of diameter reduction following its winding over the underlying layer 18 of strands, such as by passing the thus completed cable assemblage through a third reducing die 32. This procedure and sequence of circumferentially compressing each helically wound layer of strands following its winding, namely each successive overlying layer, in sequence to a regressively reduced degree of compression or diameter reduction is continued for each succeeding overlying layer of helically wound strands applied in the cable construction. However, the total reduction of the outermost overall diameter of the completed composite cable assemblage from the sequentially differentially compressed layers of helically wound strands should not be more than about 3 percent, and preferably the diameter thereof reduced about 2.5 percent, to comply with the standard for compressed stranded cable and more significantly to provide optimum properties and advantages.

For example, in a concentric cross lay cable having three layers of strands comprising six, twelve and eighteen strands respectively per layer as illustrated, the innermost layer 16 of six helically wound strands can be circumferentially compressed to reduce the diameter thereof about seven percent, the next layer 18 of twelve helically wound strands can be circumferentially compressed to reduce the diameter of such an incomplete assemblage about four percent, and the last layer 20 of eighteen helically wound strands can be circumferentially compressed to reduce the diameter of such a completed assemblage about 2.5 percent.

The mechanism of the method, and effects thereof of this invention are demonstrated in relation to two procedures of the prior art for producing compressed cable of the same lay pattern and number and size of strands in a theoretical comparison presented in the following table, namely a three layer conductor of 37 strands measuring about 0.100 inch in diameter (approx. 350 MCM).

TABLE I

| | PRIOR ART | | INVENTION |
|---|---|---|---|
| | Diameter (% Diameter Reduction) | | |
| Strand Layer | Outside Layer Compressed 2.5% | Each Layer Compressed 2.5% | Differential Compression |
| Center | .1000 (0) | .1000 (0) | .1000 (0) |
| 6 | .3000 (0) | .2925 (2.5) | .2825 (5.83) |
| 12 | .5000 (0) | .4875 (2.5) | .4825 (3.5) |
| 18 | .6825 (2.5) | .6825 (2.5) | .6825 (2.5) |

Specific examples for the practice of this invention employing conventional wire stranding means and annular reducing dies (for example see U.S. Pat. No. 1,943,087) for the assembly of multi-layered, concentric cross lay stranded cable, and of the new and improved cable product thereof for electrical conductors, are provided by the following table of conditions used for effectuating the differential compression operations for several cable conductor sizes, and of the resultant cable product dimensions. The data of Table II comprises the conductor size according to the standards of the electrical industry; the original metal strand stock diameter size and the strand diameter size after its winding into the cable assemblage which is then somewhat reduced due to stretching; the total number of strands in each type of conductor; and the outside diameter of each type of conductor without any compression. Next the table gives the diameter of the reducing dies suitable for use according to this invention for differentially compressing each layer of wound strands in sequence and the percentage of reduction in the diameter of strand wound assemblage at each stage of the compression. Then, in the last column to the right of Table II, the final outside diameter of the complete assemblage of helically wound layers of strands for each size of conductor having been differentially compressed according to this invention is given for comparison with the outside diameters of the same cable constructions which have not been compressed.

TABLE II

DIFFERENTIAL COMMPRESSION OF THE MULTI-LAYERED CONCENTRIC CROSS LAY STRANDED CABLE

| Cond. Size AWG/ MCM | Strd. Size Orig. Mils, | Strd. Size Wound Mils. | No Strds. In Cond. | O. D. Wound Cond. Mils. | Die Size (Diameter-Mils.)-Percent Layer Reduction 6 Strd. Layer Die Dia. | % | 12 Strd. Layer Die Dia. | % | 18 Strd. Layer Die Dia. | % | 24 Strd. Layer Die Dia. | % | Final Cond. O. D. Mils of Differentially Compressed Product |
|---|---|---|---|---|---|---|---|---|---|---|---|---|---|
| AWG. | | | | | | | | | | | | | |
| 2 | 98.4 | 97.4 | 7 | 292 | 284.7 | 2.5 | | | | | | | 285 |
| 1 | 67.1 | 66.4 | 19 | 332 | 189.8 | 4.7 | 923.7 | 2.5 | | | | | 324 |
| 1/0 | 75.3 | 74.5 | 19 | 373 | 213.4 | 4.5 | 363.7 | 2.5 | | | | | 364 |
| 2/0 | 84.5 | 83.7 | 19 | 418 | 238.5 | 4.8 | 407.5 | 2.5 | | | | | 408 |
| 3/0 | 95.0 | 94.0 | 19 | 470 | 268.0 | 4.9 | 458.2 | 2.5 | | | | | 458 |
| 4/0 | 106.6 | 105.5 | 19 | 528 | 301.8 | 4.6 | 514.8 | 2.5 | | | | | 515 |
| MCM | | | | | | | | | | | | | |
| 250 | 83.1 | 82.2 | 37 | 575 | 228.6 | 7.3 | 394.8 | 3.9 | 560.6 | 2.5 | | | 561 |
| 350 | 98.3 | 97.3 | 37 | 681 | 270.8 | 7.2 | 467.4 | 3.9 | 664.0 | 2.5 | | | 664 |
| 500 | 117.4 | 116.2 | 37 | 813 | 323.9 | 7.1 | 558.3 | 3.9 | 792.7 | 2.5 | | | 793 |
| 600 | 100.2 | 99.2 | 61 | 893 | 269.8 | 9.3 | 470.2 | 5.2 | 670.6 | 3.4 | 870.7 | 2.5 | 871 |
| 700 | 108.2 | 107.1 | 61 | 964 | 290.8 | 9.4 | 507.2 | 5.3 | 723.6 | 3.5 | 940.0 | 2.5 | 940 |
| 750 | 112.0 | 110.9 | 61 | 998 | 301.0 | 9.5 | 525.0 | 5.3 | 749.0 | 3.5 | 973.0 | 2.5 | 973 |
| 800 | 115.7 | 114.5 | 61 | 1031 | 310.8 | 9.5 | 542.2 | 5.3 | 773.6 | 3.5 | 1005.0 | 2.5 | 1005 |
| 900 | 122.8 | 121.5 | 61 | 1094 | 330.2 | 9.4 | 575.8 | 5.2 | 821.4 | 3.4 | 1067.0 | 2.5 | 1067 |
| 1000 | 129.3 | 128.0 | 61 | 1152 | 347.2 | 9.6 | 605.8 | 5.3 | 864.4 | 3.5 | 1123.0 | 2.5 | 1123 |

The new differentially compressed, multi-layered, concentric cross lay stranded cable conductors of this invention, produced according to the constructions and compressing conditions (reducing die sizes) as specified in Table II, were substantially free of any indentations or notches at the locations of their intersections or crossing contact with strands of adjacent layers, relatively flexible and retained their relative arrangement of tight abutting contact between the parallel aligned strands of each layer during bending or flexing whereby they provide an effective barrier preventing entry or penetration therebetween of plastic material extrusion molded thereabout at high pressures.

Electrical conductor products of improved properties in several sizes of differentially compressed, multi-layered, concentric cross lay cable were produced according to the materials and conditions set forth in Table II and then were enclosed by conventional extrusion molding means with typical multi-layered electrical conductor coverings, such as disclosed in U.S. Pat. No. 3,878,319.

These electrical conductor products included such cables comprising a body 24 of an inner covering or conductor shield of semiconductive material and an overlying covering of a body 26 of primary dielectric insulation extrusion molded thereover. The novel and improved products of the invention had enhanced flexibility, utilized reduced amounts of plastic covering material to provide the necessary thickness of the various insulating or enclosing materials, and were free of internal plastic material due to penetration or "strike through" without the presence of an added barrier component intermediate the conductor and enclosing insulating materials.

Although the invention has been described with reference to certain specific embodiments thereof, numerous modifications are possible and it is desired to cover all modifications falling within the spirit and scope of this invention.

What we claim as new and desire to secure by Letters Patent of the United States is:

1. A compressed, multi-layered, concentric lay stranded cable with each succeeding overlying layer of strands helically wound in an alternately opposite direction to any adjoining layers of strands and circumferentially compressed without discernible strand deformation to an overall outside diameter reduction of not more than about three percent of its uncompressed diameter, said multi-layered, concentric lay stranded cable having each succeeding overlying, oppositely helically wound layer of strands circumferentially differentially compressed without discernible strand deformation to a regressively reduced degree of compression, whereby the strands of the layers helically wound in alternately opposite directions are substantially free of any indentations at intersections with strands of adjoining layers.

2. The compressed, multi-layered, concentric lay stranded cable of claim 1, which comprises a central strand with at least two layers of strands helically wound in alternately opposite directions thereabout.

3. A compressed, multi-layered, concentric lay stranded cable comprising a central strand and at least two layers of overlying strands with each succeeding overlying layer of strands helically wound in an alternately opposite direction to adjoining layers of strands and circumferentially compressed without discernible strand deformation to an overall outside diameter reduction of not more than about three percent of its uncompressed diameter, said multi-layered, concentric lay stranded cable having each succeeding overlying, oppositely helically wound layer of strands circumferentially compressed without discernible strand deformation in sequence to a regressively reduced degree of compression, whereby the overall diameter of the cable is reduced and the strands of the layers helically wound in alternately opposite direction are substantially free of any impeding indentations at intersections with crossing strands of adjoining layers.

4. The compressed, multi-layered, concentric lay stranded cable of claim 3, wherein the circumferentially differentially compressed cable has been compressed to an overall outside diameter reduction of approximately 2.5 percent of its uncompressed diameter.

5. The compressed, multi-layered, concentric lay stranded cable of claim 3, wherein the stranded cable comprises an electrical conductor having a covering of dielectric insulating material thereabout, and confined to only the outside surface of the outer layer of strands.

6. An electrical conductor comprising a compressed, multi-layered, concentric lay metal stranded cable comprising a central strand and at least two layers of overlying strands with each succeeding overlying layer of strands helically wound in an alternately opposite direction to adjoining layers of strands and circumferentially compressed without discernible strand deformation to an overall outside diameter reduction of not more than about three percent of its uncompressed diameter, said multi-layered, concentric lay stranded electrical conductor cable having each succeeding overlying, oppositely helically wound layer of strands circumferentially differentially compressed without discernible strand deformation to a regressively reduced degree of compression, whereby the overall diameter of the cable is reduced in diameter up to about three percent and the strands of the layers helically wound in alternately opposite direction are substantially free of any identations at intersections with crossing strands of adjoining layers.

7. The electrical conductor comprising a compressed, multi-layered, concentric lay metal stranded cable of claim 6, wherein the first layer of helically wound strands overlying the central strand comprises six strands and each succeeding overlying layer of strands increases in the number of strands in multiples of six.

8. An electrical conductor comprising a compressed, multi-layered, concentric lay metal stranded cable comprising a central strand and a plurality of overlying layers of strands with each succeeding overlying layer of strands increasing in number of strands in multiples of six and being helically wound in an alternately opposite direction to adjoining layers of strands and circumferentially compressed without discernible strand deformation to an overall outside diameter reduction of not more than about three percent of its uncompressed diameter, said multi-layered, concentric lay stranded electrical conductor cable having each succeeding overlying, oppositely helically wound layer of strands circumferentially differentially compressed without discernible strand deformation in sequence to a regressively reduced degree of compression, whereby the overall diameter of the cable is reduced in diameter up to about three percent and the strands of the layers helically wound in alternately opposite direction are substantially free of any indentations at intersections with crossing strands of adjoining layers.

9. The electrical conductor comprising a compressed, multi-layered, concentric lay metal stranded cable of claim 8, wherein the innermost layer of strands helically wound on the central strand has been circumferentially compressed to an outside layer diameter of greater than about four percent of its original layer diameter, and the outermost layer of overlying helically wound strands has been circumferentially compressed to an overall outside diameter of approximately 2.5 percent of its uncompressed diameter.

10. The electrical conductor comprising a compressed, multi-layered, concentric lay metal stranded cable of claim 8, wherein the innermost layer of strands helically wound on the central strand has been circumferentially compressed to an outside layer diameter of greater than about seven percent of its original layer diameter, and the outermost layer of overlying helically wound strands has been circumferentially compressed to an overall outside diameter of approximately 2.5 percent of its uncompressed diameter.

11. A method of producing a compressed, multi-layered, concentric lay stranded cable with each succeeding overlying layer of strands helically wound in an alternately opposite direction to any adjoining layers of strands and circumferentially compressed without discernible strand deformation to an overall outside diameter reduction of not more than about three percent of its uncompressed diameter, comprising the steps of helically winding a plurality of strands to form a layer of strands and circumferentially compressing without discernibly deforming the helically wound layer of strands to a relatively high level of compression, then applying at least another succeeding overlying layer of strands helically wound in opposite direction to the underlying layer of strands and circumferentially compressing without discernibly deforming each of said succeeding overlying layers of helically wound strands to a regressively reduced degree of compression, whereby the strands of the layers helically wound are substantially free of any indentations at intersections with strands of adjoining layers.

12. The method of producing a compressed, multi-layered, concentric lay stranded cable of claim 11, wherein at least two layers of strands helically wound in alternatingly opposite directions are applied about the central strand.

13. A method of producing a compressed, multi-layered, concentric lay stranded cable comprising a central strand and at least two layers of overlying strands with each succeeding overlying layer of strands helically wound in an alternately opposite direction to any adjoining layers of strands and circumferentially compressed without discernible stand deformation to an overall outside diameter reduction of not more than about three percent of its uncompressed diameter, comprising the steps of helically winding a plurality of strands around a central strand to form a layer of strands overlying the central strand and circumferentially compressing without discernibly deforming the helically wound layer of strands overlying the central strand to reduce its diameter at least about four percent of its original diameter, then applying at least another succeeding overlying layer of strands helically wound in an opposite direction to the underlying layer of strands and circumferentially compressing without discernibly deforming each of said succeeding overlying layer of helically wound strands in sequence to a regressively reduced degree of compression of at least about 2.5 percent of its uncompressed diameter, whereby the strands of the layers helically wound are substantially free of any impeding indentations at intersections with crossing strands of adjoining layers.

14. The method of producing a compressed, multi-layered, concentric lay stranded cable of claim 13, wherein the circumferentially compressed cable is compressed to an overall outside diameter reduction of approximately 2.5 percent of its uncompressed diameter.

15. The method of producing a compressed, multi-layered, concentric lay stranded cable of claim 13, wherein a covering a dielectric insulating material is applied around the compressed stranded cable.

16. A method of producing an electrical conductor comprising a compressed, multi-layered, concentric lay metal stranded cable comprising a central strand and at least two layers of overlying strands with each succeeding overlying layer of strands helically wound in an alternately opposite direction to adjoining layers of strands and circumferentially compressed without discernible strand deformation to an overall outside diameter reduction of not more than about three percent of its uncompressed diameter, comprising the steps of helically winding at least two layers of strands about the central strand with each layer of strands wound in alternately opposite directions to adjoining layers of strands, and circumferentially differentially compressing without discernibly deforming each succeeding overlying, oppositely helically wound layer of strands in sequence to a regressively reduced degree of compression, whereby the strands of the layers helically wound are substantially free of any indentations at intersections with crossing strands of adjoining layers.

17. The method of producing an electrical conductor comprising a compressed, multi-layered, concentric lay metal stranded cable of claim 16, wherein the first layer of helically wound strands overlying the central strand comprises six strands and each succeeding overlying layer of strands increases in the number of strands in multiples of six.

18. A method of producing an electrical conductor comprising a compressed, multi-layered concentric lay metal stranded cable comprising a central strand and a plurality of overlying layers of strands with each succeeding overlying layer of strands increasing in number of strands in multiples of six and being helically wound in an alternately opposite direction to adjoining layers of strands and circumferentially compressed without discernible strand deformation to an overall outside diameter reduction of not more than about three percent of its uncompressed diameter, comprising the steps of helically winding a plurality of strands around a central strand to form a layer of strands overlying the central strand and circumferentially compressing without discernibly deforming the helically wound layer of strands overlying the central strand by passing same through a reducing die to reduce its diameter at least about four percent of its original diameter, then applying at least another succeeding overlying layer of strands helically wound in an opposite direction to the underlying layer of strands and circumferentially compressing without discernibly deforming each of said succeeding overlying layers of helically wound layer strands by passing each in sequence through a reducing die to differentially compress each in sequence to a regressively reduced degree of compression, and extent so that the strands of the layers helically wound are not substantially indented at intersections with crossing strands of adjoining layers.

19. A method of producing an electrical conductor comprising a compressed, multi-layered concentric lay metal stranded cable comprising a central strand and a plurality of overlying layers of strands with each succeeding overlying layer of strands increasing in number of strands in multiples of six and being helically wound in an alternately opposite direction to adjoining layers of strands and differentially circumferentially compressed without discernible strand deformation to an overall outside diameter reduction of not more than about three percent of its uncompressed diameter, comprising the steps of helically winding a plurality of strands around a central strand to form a first layer of strands overlying the central strand and circumferentially compressing without discernibly deforming the helically wound layer of strands overlying the central strand by passing same through a reducing die to reduce its diameter at least about seven percent of its original diameter, then applying at least two succeeding overlying layers of strands wound in an opposite direction to each adjacent layer of strands and in sequence circumferentially compressing without discernible deforming the second of said helically wound layer of strands by passing some through a reducing die to reduce its diameter at least about four percent of its original diameter and circumferentially compressing without discernibly deforming the third of said helically wound layers of strands by passing same through a said helically wound layers of strands by passing same through a reducing die to reduce its diameter at least about 2.5 percent of its original diameter, and extent so that the strands of the layers helically wound are not substantially indented at intersections with crossing strands of adjoining layers.

20. The method of producing an electrical conductor comprising a compressed, multi-layered, concentric lay metal stranded cable of claim 19 wherein at least four layers of strands are sequentially applied overlying the central strand and helically wound in alternatingly opposite directions to adjoining layers of strands, and each helically wound layer of strands is differentially circumferentially compressed without discernible strand deformation in sequence by passing time through a reducing die to reduce the diameter of the first layer of helically wound strands to at least about nine percent of its original diameter, reduce the diameter of the second layer of helically wound strands to at least about 5 percent of its original diameter, reduce the diameter of the third layer of helically wound strands to at least about three percent of its original diameter, and reduce the diameter of the fourth layer of helically wound strands to at least about 2.5 percent of its original diameter.

21. An insulated electrical conductor comprising a compressed, multi-layered, concentric lay metal stranded cable comprising a central strand and at least two layers of overlying strands with each succeeding overlying layer of strands helically wound in an alternately opposite direction to adjoining layers of strands and circumferentially compressed without discernible strand deformation to an overall outside diameter reduction of not more than about three percent of its uncompressed diameter, said multi-layered, concentric lay stranded electrical conductor cable having each succeeding overlying, oppositely helically wound layer of strands circumferentially differentially compressed without discernible strand deformation to a regressively reduced degree of compression, whereby the overall diameter of the cable is reduced in diameter up to about three percent and the strands of the layers helically wound in alternately opposite direction are substantially free of any indentations at intersections with crossing strands of adjoining layers, and having a covering of dielectric polymeric insulation material extrusion molded thereover.

22. The insulated electrical conductor of claim 21 which is free of any internal polymeric insulation material penetrated through the overlying layer of helically wound strands.

23. An electrical conductor covered with a conductor shield of semiconductive material and a dielectric insulating material comprising a compressed, multi-layered, concentric lay metal stranded cable comprising a central strand and a plurality of overlying layers of strands with each succeeding overlying layer of strands increasing in number of strands in multiples of six and being helically wound in an alternately opposite direction to adjoining layers of strands and circumferentially compressed without discernible strand deformation to an overall outside diameter reduction of not more than about three percent of its uncompressed diameter, said multi-layered, concentric lay stranded electrical conductor cable having each succeeding overlying, oppositely helically wound layer of strands circumferentially differentially compressed without discernible strand deformation in sequence to a regressively reduced degree of compression, whereby the overall diameter of the cable is reduced in diameter up to about three percent and the strands of the layers helically wound in alternately opposite direction are substantially free of any indentations at intersections with crossing strands of adjoining layers, and having a covering comprising an inner conductor shield of semiconductive polymeric material and an overlying dielectric insulating polymeric material.

24. The covered electrical conductor of claim 23 which is free of any internal polymeric material penetrated through the outermost overlying layer of helically wound strands.

* * * * *